US006135050A

United States Patent [19]

Inaba et al.

[11] Patent Number: 6,135,050

[45] Date of Patent: Oct. 24, 2000

[54] COATING MASK DEVICE

[75] Inventors: Keiichi Inaba; Kiyoshi Yazaki, both of Shizuoka, Japan

[73] Assignee: Koito Manufacturing Co., Ltd., Tokyo, Japan

[21] Appl. No.: 09/359,072

[22] Filed: Jul. 22, 1999

[30] Foreign Application Priority Data

Jul. 22, 1998 [JP] Japan ..... 10-206540

[51] Int. Cl.[7] ..... B05B 15/04

[52] U.S. Cl. ..... 118/301

[58] Field of Search ..... 118/301

[56] References Cited

FOREIGN PATENT DOCUMENTS 4-338252 11/1992 Japan .

*Primary Examiner*—Richard Bueker

*Attorney, Agent, or Firm*—Sughrue, Mion, Zinn, Macpeak & Seas, PLLC

[57] ABSTRACT

A coating mask device includes a base 10 on which on a jig bed 30 is mounted. The jig bed 30 supports the support jig 40, which receives a product W to be coated. A mask support frame 20, having a mask body 22 formed integrally therewith, is mounted on the base 10 so as to be pivotally moveable between a closed position in which the mask body 22 covers the support jig 40 and an open position in which the mask body exposes an upper side of the support jig 40. The mask body 22 corresponds in shape to the product to be coated. The mask support frame 20 is detachably mounted on the base 10, and the support jig 40 is detachably mounted on the jig bed 30.

11 Claims, 10 Drawing Sheets

COATING MASK DEVICE

BACKGROUND OF THE INVENTION

1. Field of the Invention

This invention relates to a coating mask device used for applying a coating only to a desired portion of a molded product serving, for example, as a component part of a lighting device for a vehicle, such as a lens and a lamp body.

2. Related Art

FIG. 12 illustrates a conventional coating mask device. The device includes a base 1 on which a jig bed 2 is mounted. The jig bed 2 supports a support jig 3. The support jig 3 receives a product 7 to be coated. A mask support frame 5 is pivotally mounted to the base 1. The mask support frame 5 is integrally formed with a mask body 6 having a shape that corresponds to the shape of the product 7. The mask support frame 5 is pivotable between a closed position (indicated in phantom in FIG. 12) in which the mask body 6 covers the support jig 3 and the product 7 and an open position (indicated in solid lines in FIG. 12) in which the mask body 6 exposes the upper side of the support jig 3 and the product 7.

A link mechanism 4 moves the jig bed 2 upward and downward, and a lever 4*a* moves the link mechanism 4 upward and downward. When the mask support frame 5 is closed, the support jig 3 is moved upward so that the mask body 6 properly covers the product 7.

The mask body 6 includes an opening (not shown) corresponding to a coat-forming region of the product 7. When the mask body 6 covers the product 7, a spray coating is applied from the upper side of the mask body 6, thereby applying the coating only to the coat-forming region of the product 7.

Although generally thought to be acceptable, these conventional devices are not without shortcomings. In particular, the device is designed according to the specific product configuration. Therefore, in order to coat a product having a different configuration, the entire coating mask device must be redesigned. This redesign impacts the mask body 6 and the support jig 3 (which directly relate to the product configuration), as well as the base 1 and the jig bed 2. Such extensive redesign is time consuming and expensive.

In addition, conventional coating mask devices are incorporated into a production line. Therefore, if products having different configurations are processed through the same production line, then one coating mask device must be removed from the production line and a different coating mask device must be installed in the production line. This remove and replace process is very cumbersome. Furthermore, a large space is required for storing the coating mask devices removed from the production line.

SUMMARY OF THE INVENTION

It is an object of this invention to provide a coating mask device in which a mask support frame, having a mask body formed integrally therewith, and a support jig have a detachable construction so that the coating mask device can be easily adapted to products having different configurations.

An embodiment defined by claim 1 includes a coating mask device wherein a support jig, on which a product to be coated can be placed, is supported on a jig bed mounted on a base, and a mask support frame, having a mask body formed integrally therewith, is mounted on the base so as to be pivotally moved between a closed position in which the mask body covers the support jig and an open position in which the mask body exposes the support jig. The mask body corresponds in shape to the product to be coated. The mask support frame is detachably mounted on the base, and the support jig is detachably mounted on the jig bed.

When products having different configurations are to be coated, a new mask support frame, having a mask body (corresponding to the new configuration) formed integrally therewith, as well as a new support jig (corresponding to the new configuration), is prepared. The current mask support frame and the current support jig are removed from the coating mask device, and the new mask support frame and the new support jig are mounted on the coating mask device. In this way, different kinds of products can be coated.

Even if the coating mask device is incorporated in a production line, it is only necessary to exchange the mask support frame and the support jig. Therefore the exchange operation is easy and quick.

Additionally, the removed mask support frame and support jig are much smaller in size than an entire coating mask device. Therefore, a required storage space is smaller as compared with the case where the entire coating mask device is stored.

In the coating mask device of claim 2, a first mounting plate is mounted on the jig bed, and an second mounting plate is mounted on the support jig, such that the second mounting plate is superposed on the first mounting plate, and is positioned and fixed relative to the first mounting plate through convex and concave engagement portions. The second mounting plate is superposed on the first mounting plate in such a manner that their convex and concave engagement portions are engaged with each other, thereby positioning the support jig relative to the jig bed.

In the coating mask device of claim 3, the first and second mounting plates have pin insertion holes extending through the convex and concave engagement portions, and by sliding a slide pin inserted in the pin insertion holes, the first and second mounting plates can be connected together and disconnected from each other. When the slide pin is inserted in the pin insertion holes of the first and second mounting plates, the two mounting plates are interconnected, and when the slide pin is withdrawn from the pin insertion holes of one of the two mounting plates, the two mounting plates are disconnected from each other.

In the coating mask device of claim 4 according to claim 1, claim 2 or claim 3, the jig bed can be moved upward and downward by an elevating mechanism. Therefore, the product to be coated can be accurately positioned relative to the mask body.

The above and other features of the invention including various and novel details of construction and combination of parts will now be more particularly described with reference to the accompanying drawings and pointed out in the claims. It will be understood that the particular coating mask device embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENT OF THE INVENTION

Figure 1:
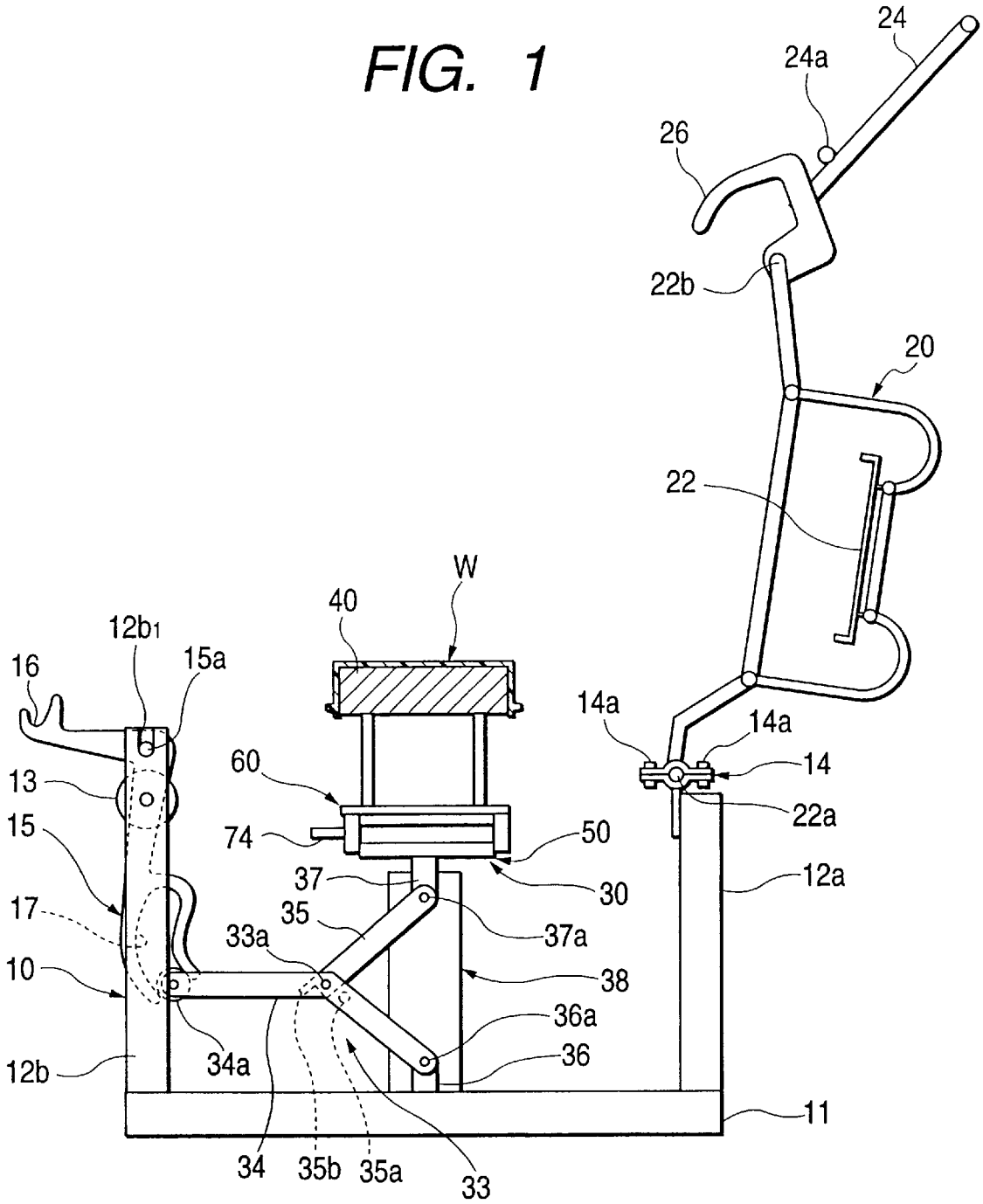
FIG. 1 is a vertical cross-sectional view showing a coating mask device according to an embodiment of the present invention.

FIGS. 1 to 11 show a coating mask device according to a preferred embodiment of the invention. A support jig 40 receives a molded product W of a synthetic resin, serving as a component part of a lighting device for a vehicle. The support jig 40 is mounted on a base 10. Specifically, the support jig 40 is fixedly mounted on a jig bed 30. The jig bed 30 is linearly moveable relative to the base 10 via a link mechanism 33.

A mask support frame 20 is pivotally mounted on the base 10 so as to be moveable between an open position and a closed position. The mask support frame 20 has a mask body 22 formed integrally therewith. The mask body 22 has a shape that corresponds to the shape of the molded product W.

Figure 4:
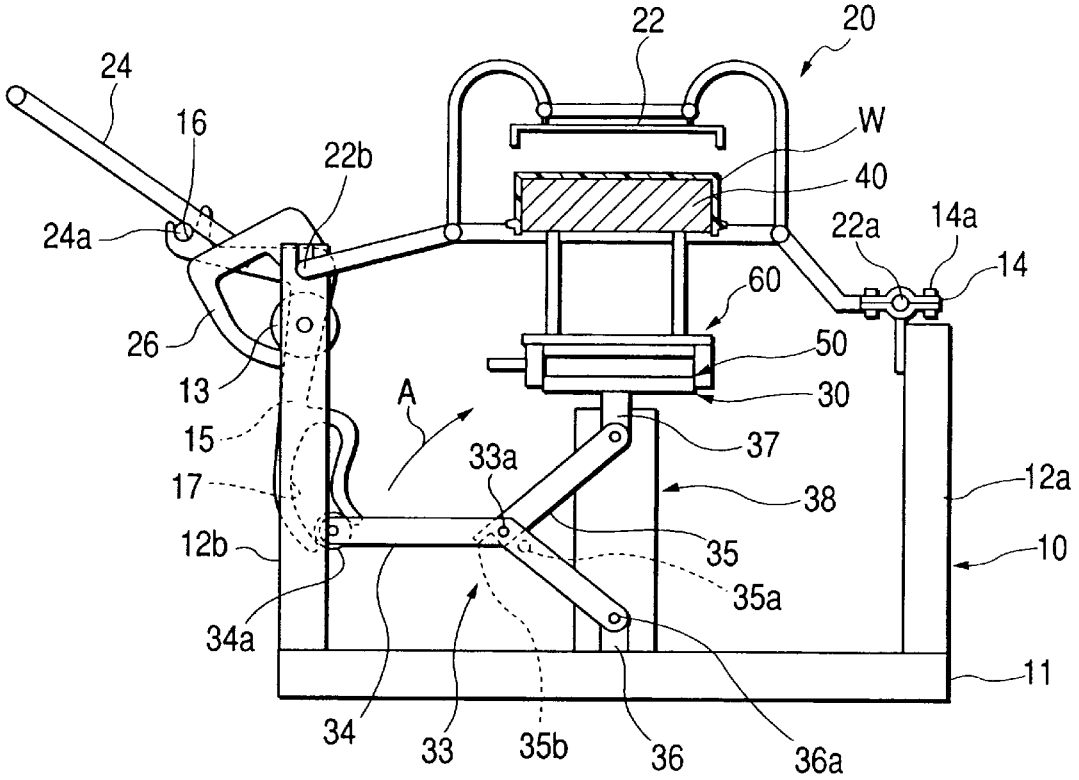
FIG. 4 is a vertical cross-sectional view of the coating mask device in a closed condition of a mask body.
Figure 5:
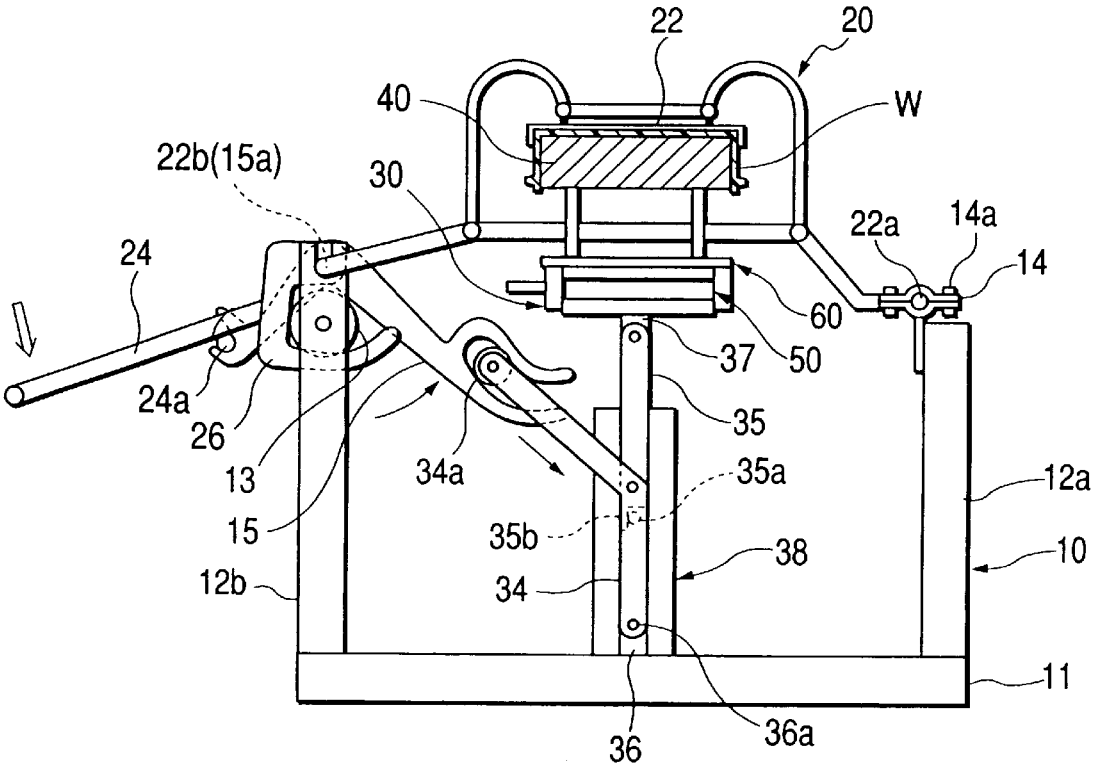
FIG. 5 is a vertical cross-sectional view of the coating mask device in a condition corresponding to a coating process.

As shown in FIG. 4, when the mask support frame 20 is closed, the mask body 22 opposes the molded product W provided on the support jig 40. And as shown in FIG. 5, the jig bed 30 is linearly moved by the link mechanism 33 toward the mask support frame 20, so that the mask body 22 covers the molded product W. except for a predetermined region thereof. In this condition, a spray coating is applied through the mask body 22 and onto the molded product W, thereby coating only the predetermined region of the molded product W.

The base 10 comprises a frame body 11 with support posts 12*a* and 12*b* extending therefrom. The frame body 11 may have, for example, a rectangular shape with the support posts 12*a* and 12*b* respectively extending from four corner portions thereof (that is, front end corner portions and rear end corner portions). A bearing 14, for supporting the mask support frame 20 in a pivotable fashion, is mounted on a free end of the support post 12*a* at the front end of the frame body 11. A rod 22*a* extends through the bearing 14. The mask support frame 20 is pivotally moveable about the rod 22*a* between the closed position (see FIGS. 4 and 5) in which the mask body 22 opposes the support jig 40 and the molded product W, and the open position (see FIG. 1) in which the mask support frame 20 is raised to expose the support jig 40 and the molded product W.

The bearing 14 is divided into halves in a direction perpendicular to the rod 22*a*. For example, the bearing 14 may have an upper half and a lower half as shown in the drawings. These halves are connected together by screws 14*a*. When the screws 14*a* are loosened and the halves of the bearing 14 are separated from each other, the mask body 22 can be detached from the support post 12*a*.

Figure 2:
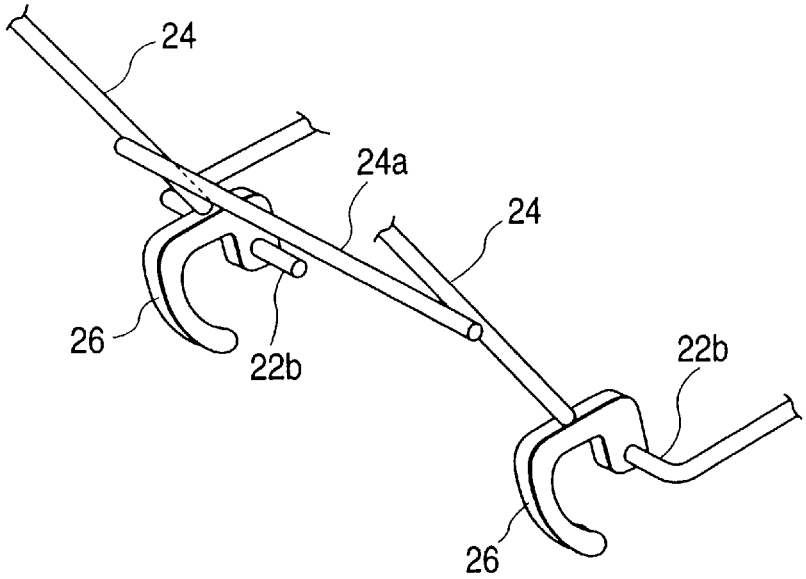
FIG. 2 is a perspective view showing hooks of a mask support frame and their neighboring portion.

As shown in FIG. 2, a pair of right and left coaxial rods 22*b* extend from the rear end of the mask support frame 20. The rods 22*b* are spaced apart from each other in an axial direction. A pair of right and left hooks 26 are pivotally mounted on the rods 22*b*, respectively. The hooks 26 are integrally with a handle 24.

Figure 3:
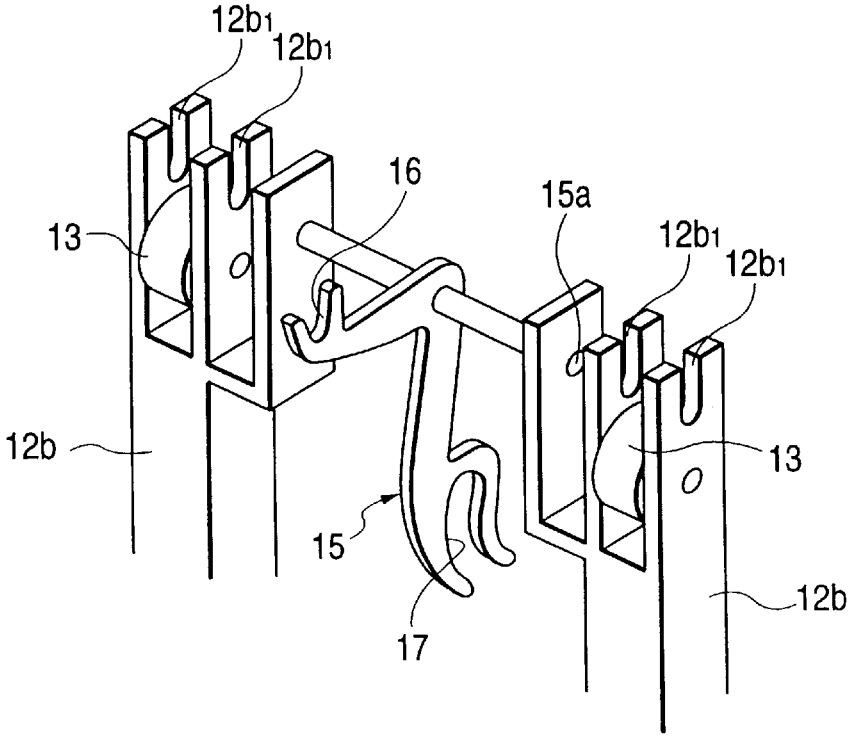
FIG. 3 is a perspective view showing an operating lever and its neighboring portion.

Turning to FIG. 3, the support posts 12*b* at the rear end of the frame body 11 have U-shaped grooves 12*b*1 for receiving the rods 22*b* of the mask support frame 20. An operating lever 15 of an L-shape is pivotally supported on a pin pivot 15*a* extending between the support posts 12*b*. The pin pivot 15*a* and the bottoms of the U-shaped grooves 12*b*1 are disposed on a common axis.

With reference to FIG. 4, upon closing the mask support frame 20, the rods 22*b* insert into the U-shaped grooves 12*b*1, and a rod 24*a* provided on the handle 24 engages with a rod engagement portion 16 of the operating lever 15. And with reference to FIG. 5, when the handle 24 is further pivotally moved, the hooks 26 are retained respectively on hook retaining portions 13 provided on the support posts 12*b*. In this way, the mask support frame 20 is held in the closed condition.

The operating lever 15 drives the link mechanism 33 of the jig bed 30. Specifically, when the mask support frame is initially closed (FIG. 4), and the handle 24 pivots in a direction of an arrow (FIG. 5), the rod 24*a* presses the rod engagement portion 16, so that the operating lever 15 rotates in a counterclockwise direction (FIG. 5) and raises the link mechanism 33.

The link mechanism 33 moves the jig bed 30 relative to the base 10. The link mechanism 33 comprises a first link 34 and a second link 35. The first link 34 is generally V-shaped having one end connected by a pin 36*a* to the base 10. Specifically, the first link 34 is connected by the pin 36*a* to a bracket 36 mounted on the frame body 11. The second link 35 has a straight configuration with one end connected by a pin 37*a* to the jig bed 30, and another end connected by a pin 33*a* to a central portion of the first link 34. The second link 35 is connected by the pin 37*a* to a bracket 37 mounted on the jig bed 30. By rotating the first link 34 about the pin 36*a*, the jig bed 30 is linearly moved with respect to the base 10.

Stoppers 35*a* are formed on opposed inner surfaces of the first link 34. These stoppers 35*a* cooperate with projections 35*b* formed at one end of the second link 35. Specifically, when the link mechanism 33 is extended, the projections 35*b* engage with the stoppers 35*a* to limit the pivotal movement of the second link 35. Cylinders 38 and guide rails 39 are provided between the frame body 11 of the base 10 and the jig bed 30 to guide the linear movement of the jig bed 30.

Figure 6:
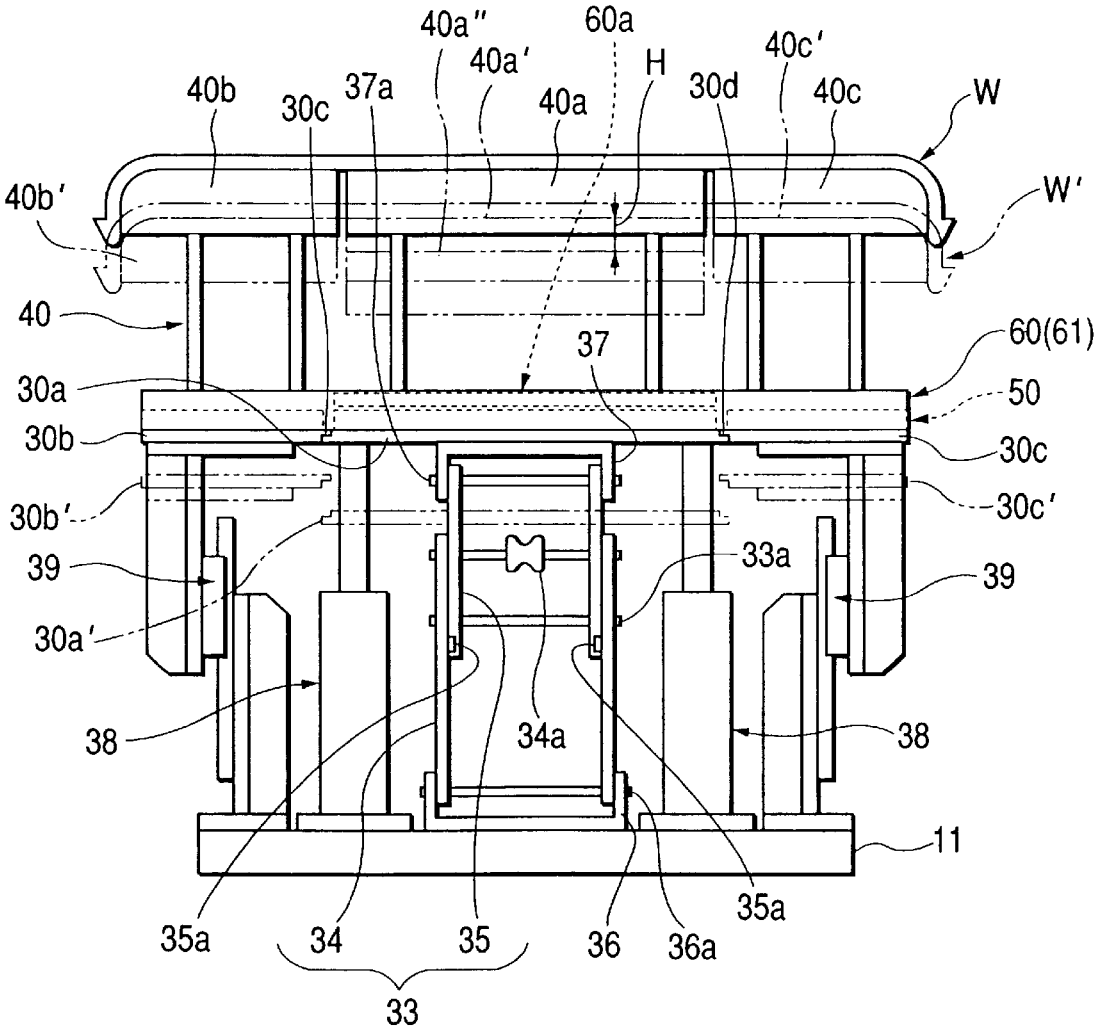
FIG. 6 is a front-elevational view of a support jig-elevating mechanism of the coating mask device.
Figure 7:
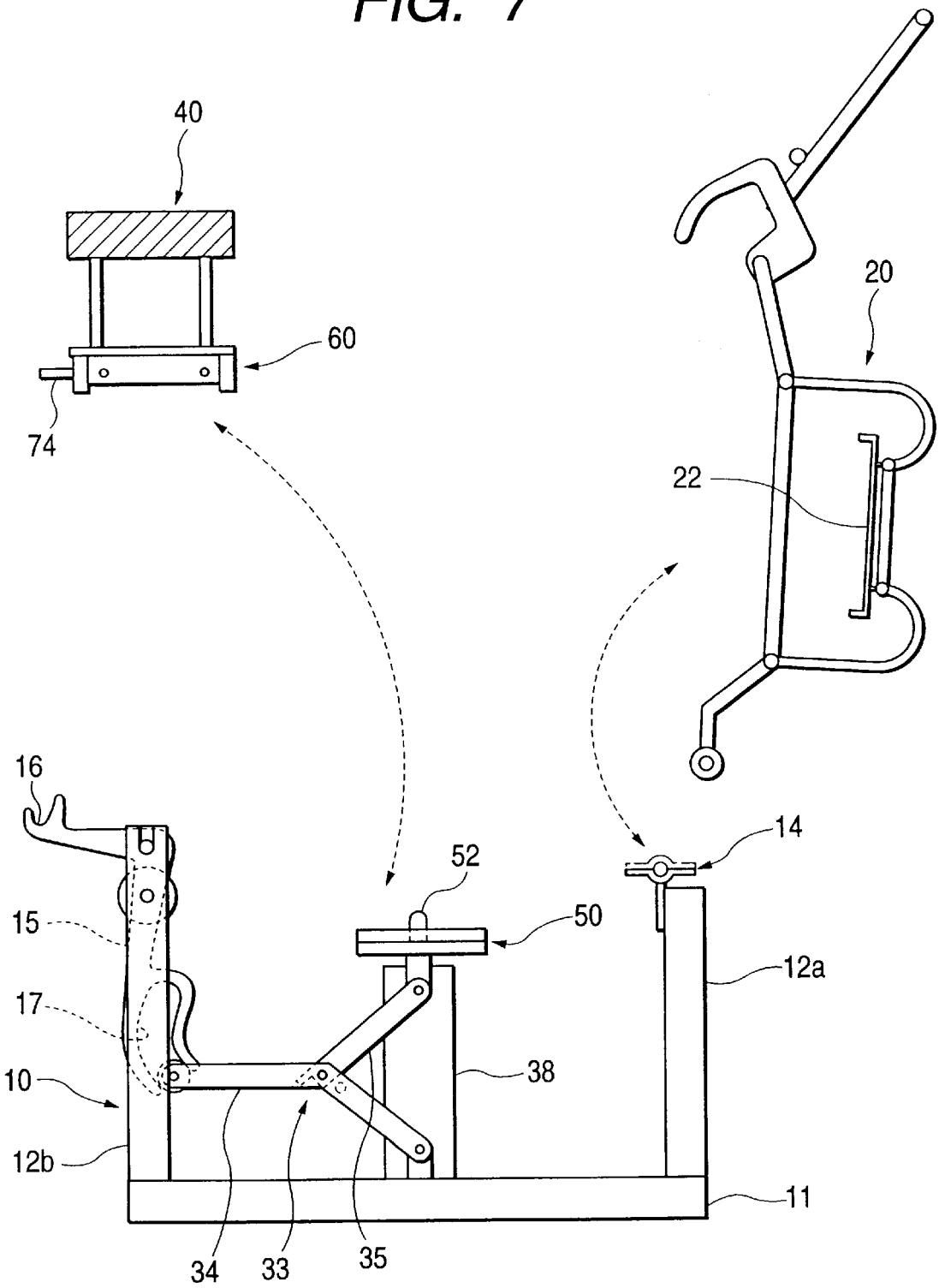
FIG. 7 is a vertical cross-sectional view of the coating mask device, with the support jig and the mask support frame removed.

As shown in FIG. 6, the jig bed 30 is divided into three portions: a central portion 30*a*; and opposite end portions 30*b*, 30*c*. The central portion 30*a* is moved directly by the link mechanism 33. The opposite end portions 30*b*, 30*c* are engaged at their inner portions with the central portion 30*a*, and are moved by the central portion 30*a*. Reference numerals 30*d* and 30*e* denote engagement portions between the jig bed portions.

In FIG. 6, reference numerals 30*a*', 30*b*' and 30*c*' denote the retracted positions of the jig bed portions 30*a*, 30*b*, 30*c*, respectively. Stopper means (not shown) provided on the guide rails 39 prevent the opposite end portions 30*b*, 30*c* from retreating beyond their respective retracted positions 30*b*', 30*c*'. During a retreating motion of the jig bed 30, the three jig bed portions 30*a*, 30*b*, 30*c* move together because the opposite end portions 30*b*, 30*c* are supported by the central portion 30*a* from the lower side. Eventually, the opposite end portions 30*b*, 30*c* are stopped by the stopper means provided on the guide rails 39, and thereafter, only the central portion 30*a* of the jig bed continues to move toward its retracted position 30*a*'. When the link mechanism 33 is extended, the opposite end portions 30*b*, 30*c* are advanced by the central portion 30*a* in unison to their respective positions indicated in solid lines in FIG. 6.

A roller 34*a* is rotatably mounted on a distal end of the first link 34. The roller 34*a* engages with a bifurcated link engagement portion 17 of the operating lever 15. Therefore, the pivoting action of the operating lever 15 and the handle 24 causes the first link 34 to pivot about the pin 36*a*. As shown in FIG. 4, when the first link 34 pivots in a direction of arrow A, the second link 35 moves toward the mask support frame 20. Accordingly, as shown in FIG. 5, the jig bed 30 is linearly displaced such that the mask body 22 covers the molded product W on the support jig 40.

A coating operation is performed while the device is in the condition shown in FIG. 5. When the coating operation is finished, the handle 24 is pivoted in a reverse direction. As a result, the hooks 26 disengage from the hook retaining portions 13 and the link mechanism 33 collapses, thereby moving the jig bed 30 to the retracted position. The handle 24 is then further moved to open the mask support frame 20, thereby exposing the support jig 40 and the molded product W. The molded product W is removed, and a fresh molded product W is placed on the support jig 40. Then, in accordance with the same procedure described above, the mask support frame 20 is closed, and the support jig 40 is linearly moved, such that the mask body 22 covers the molded product W.

A first mounting plate 50 is fixedly secured to the jig bed 30 by screws, and a second mounting plate 60 is fixedly secured to the support jig 40 by screws. The second mounting plate 60 is engaged with and fixed to the first mounting plate 50, thereby integrally connecting the support jig 40 to the jig bed 30.

The detailed constructions of the first and second mounting plates 50, 60, respectively, are shown in FIGS. 8 to 11. The second mounting plate 60 is a rectangular frame having a gate-like cross-section, and the first mounting plate 50 is a rectangular plate that fits into an opening 62 of the second mounting plate 60. The two mounting plates 50, 60 fit together in a superposed fashion. A width d of the opening 62 in the second mounting plate 60 is equal to a width d of the first mounting plate 50. The first mounting plate 50 includes positioning pins 52 that insert into engagement holes 63 provided in the second mounting plate 60, thereby positioning the two mounting plates 50, 60 relative to each other.

The first mounting plate 50 includes rectangular blocks 55 (55*a*, 55*b*, 55*c*) arranged at predetermined intervals in the longitudinal direction. The rectangular blocks 55*b*, 55*c*, which are provided at opposite ends of the first mounting plate 50, include pin insertion holes 56 for receiving a slide pin 70 (described later). The second mounting plate 60 also includes rectangular blocks 65 (65*a* and 65*b*), which are identical to the rectangular blocks 55 on the first mounting plate 50. The rectangular blocks 65 are arranged at predetermined intervals within the opening 62. The rectangular blocks 65 are arranged so that they do not overlap the rectangular blocks 55 when the two mounting plates 50, 60 are fitted together in a superposed fashion. The rectangular blocks 65 include pin insertion holes 66, 67 that correspond to the pin insertion holes 56 in the rectangular blocks 55*b*, 55*c* on the first mounting plate 50.

A slide pin 70, having an H-shape, is disposed between each pair of opposed blocks 65*b*. The slide pin 70 includes a rectangular block body 71 having a pair of parallel pins 72 extending therethrough. The pins 72 insert into the associated pin insertion holes 66, 67. The block body 71 also has a pin operating portion 74 extending therefrom. The pin operating portion 74 passes through a slot 68 formed through a body 61 of the second mounting plate 60. The slide pin 70 slides along the slot 68 via the pin operating portion 74.

Figure 8:
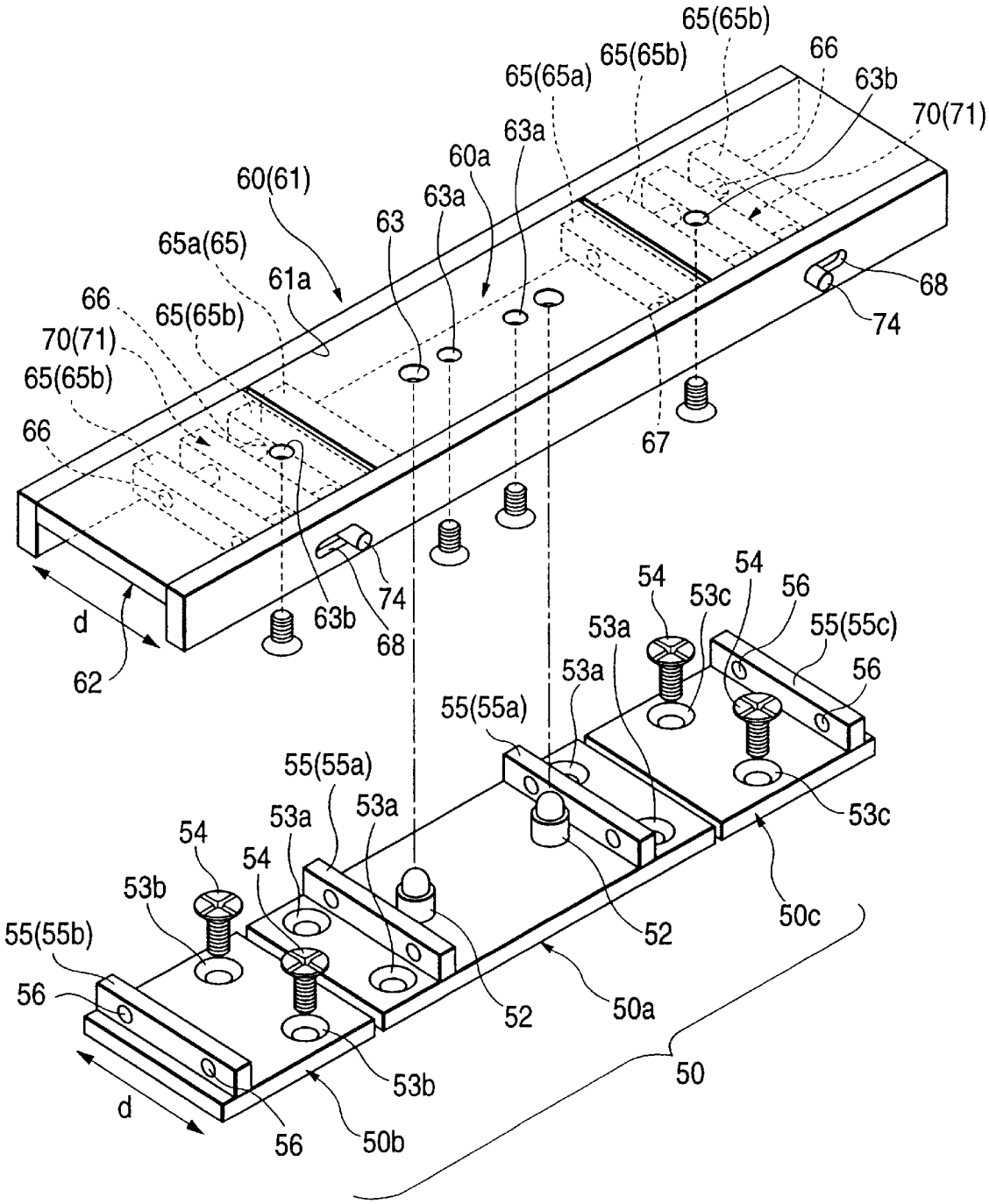
FIG. 8 is a perspective view showing a first mounting plate and a second mounting plate.
Figure 9:
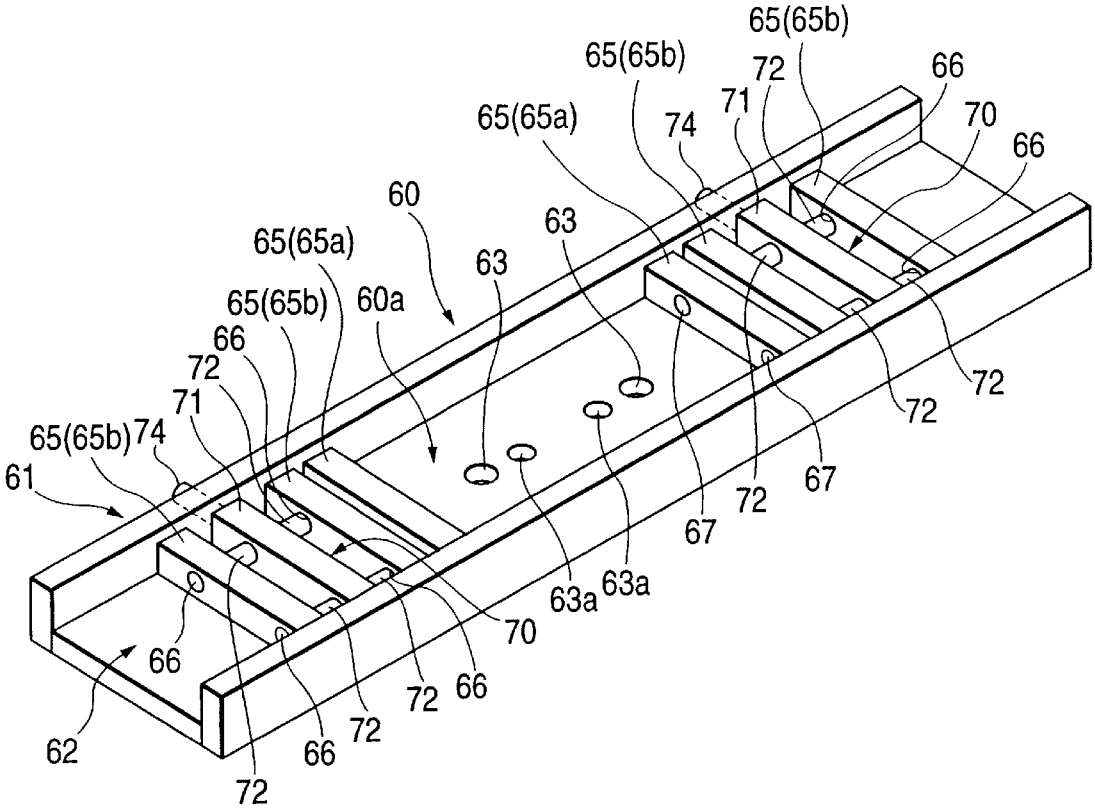
FIG. 9 is a perspective view showing the reverse side of the second mounting plate.
Figure 10:
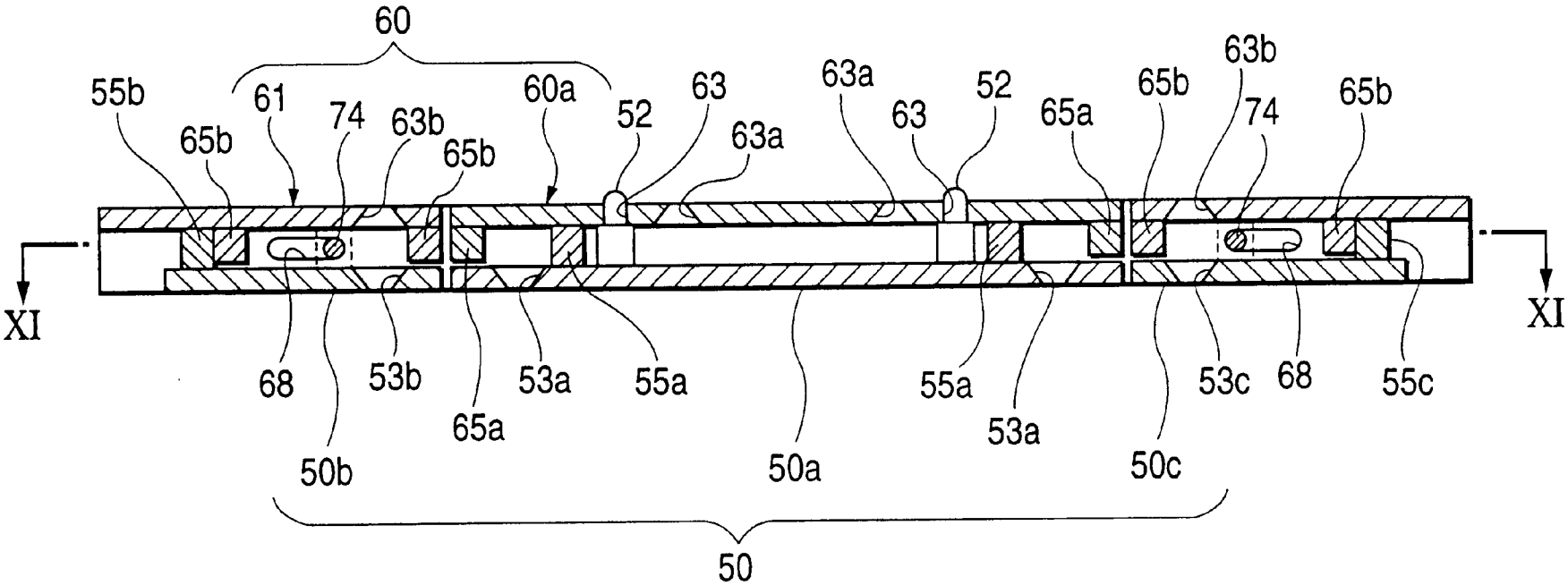
FIG. 10 is a vertical cross-sectional view showing an engagement portion between the first and second mounting plates.

When each slide pin 70 is slid toward the center of the second mounting plate 60, the pins 72 withdraw from the associated pin insertion holes 56 in the first mounting plate 50. Accordingly, the two mounting plates 50, 60 can be separated from each other, as shown in FIGS. 8 and 9. On the other hand, when each slide pin 70 is slid toward the corresponding end of the second mounting plate 60 (that is, in a direction of an arrow in FIG. 11), the pins 72 insert into the associated pin insertion holes 56 in the first mounting plate 50. Accordingly, the two mounting plates 50, 60 are interconnected through the pins 72. This sliding action allows the support jig 40 to be easily attached to and detached from the jig bed 30.

The first mounting plate 50 is divided into three plates: a central plate 50*a*; and opposite end plates 50*b*, 50*c*. Each of the plates 50*a*, 50*b*, 50*c* is respectively provided with holes 53*a*, 53*b*, 53*c*. The plates 50*a*, 50*b*, 50*c* are fixedly secured to the respective jig bed portions 30*a*, 30*b*, 30*c* via screws 54. The positioning pins 52 project from the central plate 50*a*. The rectangular blocks 55*a* are fixedly secured to opposite end portions of the central plate 50*a*, and these rectangular blocks 55*a* enable the first mounting plate 50 (50*a*) and the second mounting plate 60 to be superposed together in parallel relation to each other. The rectangular blocks 55*b*, 55*c* are fixedly secured respectively to the opposite end plates 50*b*, 50*c*. As described above, the pin insertion holes 56, for receiving the pins 72 to interconnect the first and second mounting plates 50, 60, are formed through each of the blocks 55*b*, 55*c*.

The support jig 40 is divided into three portions, including: a central portion 40*a*; and opposite end portions 40*b*, 40*c*, as shown in FIG. 6.

The second mounting plate 60 has a construction that corresponds to the divided construction of the support jig 40 (40*a*, 40*b*, 40*c*). The second mounting plate 60 comprises a plate body 61 with a top plate. The top plate has an opening 61*a* formed in a central portion thereof. The opening 61*a* corresponds in size to the central plate 50*a* of the first mounting plate 50, and receives a central plate 60*a* of a rectangular shape. The central plate 60*a* has screw holes 63*a*, and the top plate has screw holes 63*b*. The second mounting plate 60 is fixedly secured to the support jig 40 (40*a*, 40*b*, 40*c*) by screws passing respectively through the screw holes 63*a*, 63*b*. Two rectangular blocks 65*b* are fixedly secured to each of the opposite end portions of the top plate of the second mounting plate body 61. The two pin insertion holes 66 are formed through each of the opposed blocks 65*b*, and extend in the longitudinal direction in parallel relation to each other. Each slide pin 70 is provided between the opposed blocks 65*b*, with its pins 72 inserted in the pin insertion holes 66. The blocks 65*a* are fixedly secured respectively to opposite end portions of the central plate 60*a*. The blocks 65*a* include the pin insertion holes 67, which are aligned with the pin insertion holes 66 in each of the opposed blocks 65*b*.

Figure 11:
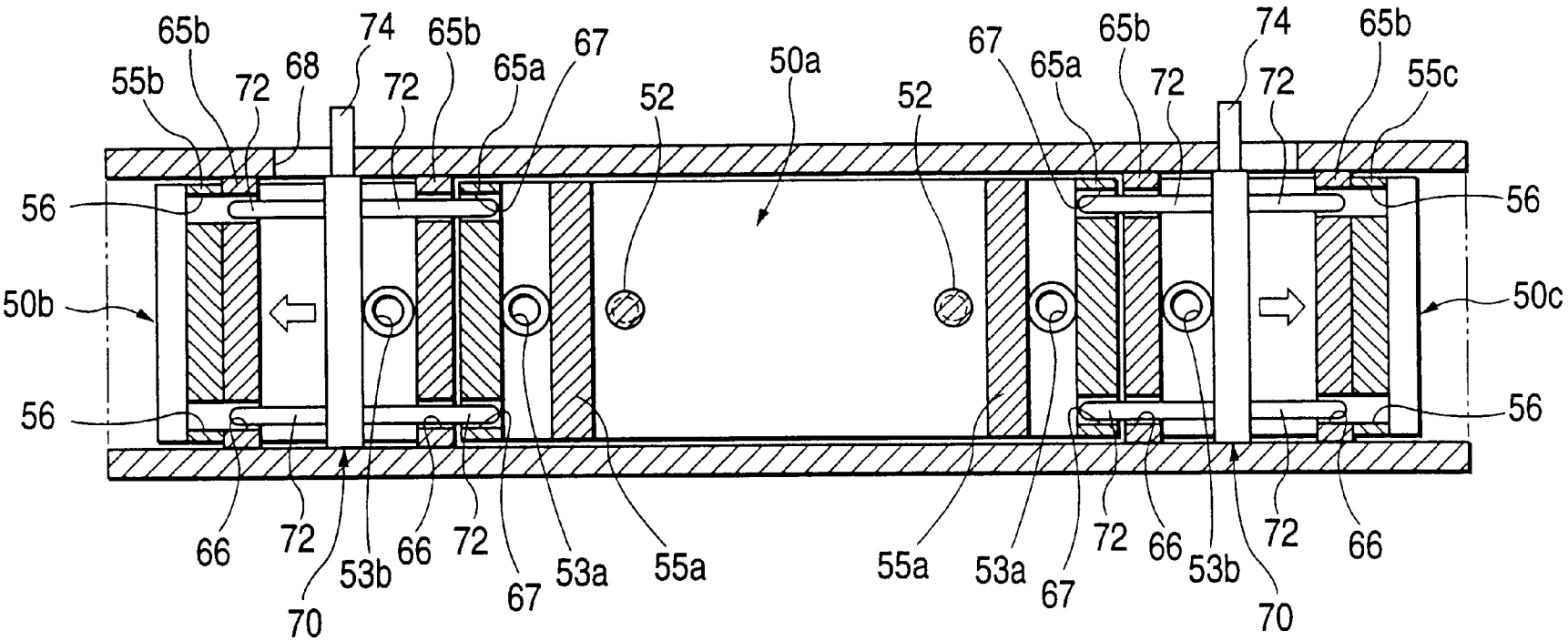
FIG. 11 is a horizontal cross-sectional view of this engagement portion (that is, a cross-sectional view taken along the line XI—XI of FIG. 10)
Figure 12:
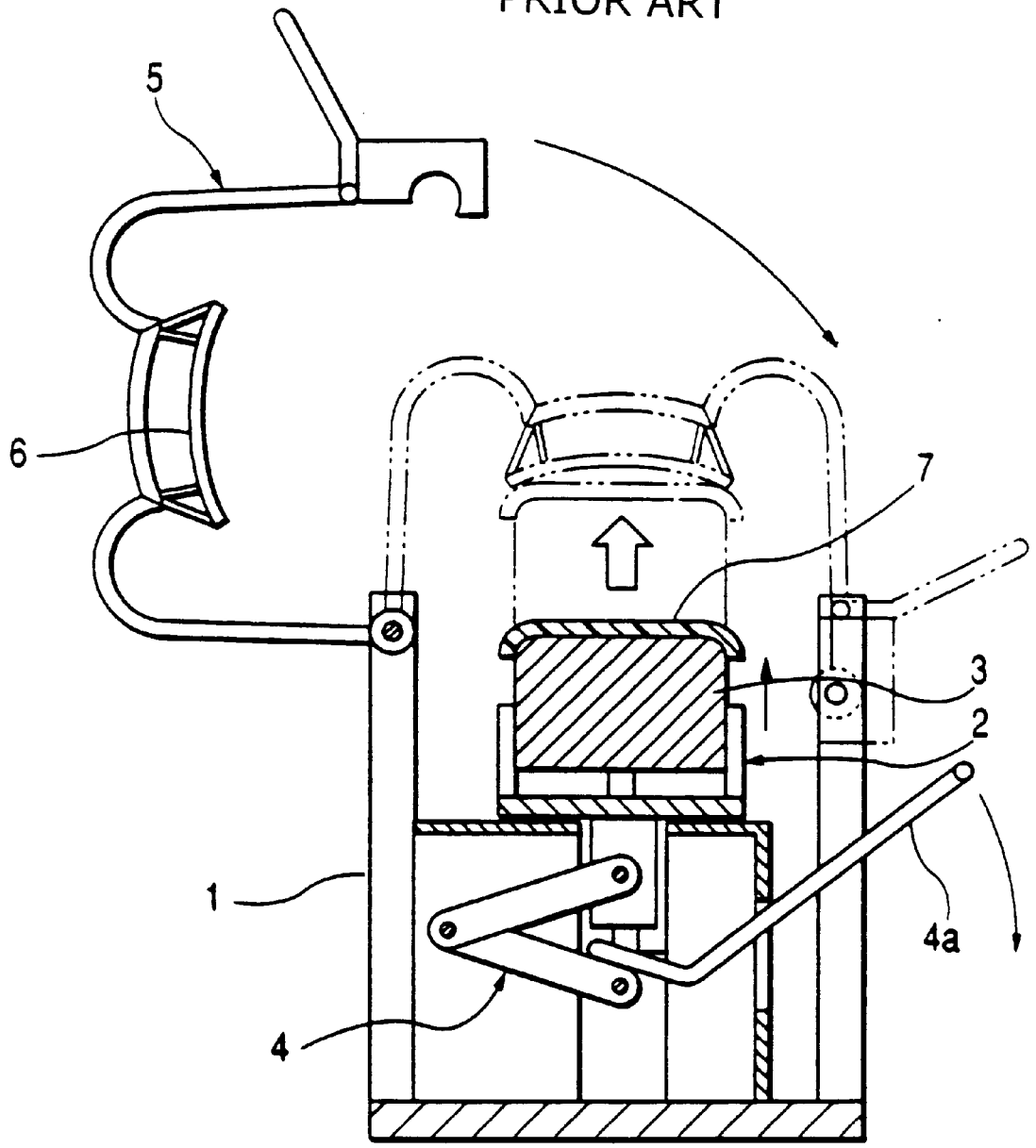
FIG. 12 PRIOR ART
FIG. 12 is a vertical cross-sectional view of a conventional coating mask device in an open condition.

When each slide pin 70 is slid toward the central opening 61*a*, the pins 72 insert into the associated pin insertion holes 67 in the block 65*a* on the central plate 60*a*. Accordingly, the plate body 61 and the central plate 60*a* are integrally connected together to form the second mounting plate 60, as shown in FIGS. 8, 9 and 11. Also, the pins 72 of each slide pin 70 withdraw from the associated pin insertion holes 56 in the blocks 55*b*, 55*c* on the first mounting plate 50. Accordingly, the second mounting plate 60 disconnects from the first mounting plate 50. In this condition, the support jig 40 (that is, the second mounting plate 60 fixedly secured to the support jig 40) can be detached from the jig bed 30 (that is, the first mounting plate 50 fixedly secured to the jig bed 30).

On the other hand, when each slide pin 70 is slid toward the corresponding end of the second mounting plate 60 (that is, in the direction of the arrow in FIG. 11), the pins 72 insert into the pin insertion holes 56 in the block 55*b*, 55*c* on the first mounting plate 50 (the opposite end plates 50*b*, 50*c*). Accordingly, the second mounting plate 60 (the plate body 61) is connected to the first mounting plate 50 (the opposite end plates 50*b*, 50*c*), that is, the support jig 40 (the second mounting plate 60 fixedly secured to the support jig 40) is connected to the jig bed 30 (the first mounting plate 50 fixedly secured to the jig bed 30). Thus, by sliding the slide pins 70, the support jig 40 is easily attached to and detached from the jig bed 30.

When the support jig 40 (the second mounting plate 60) is connected to the jig bed 30 (the first mounting plate 50) by the slide pins 70, the central plate 60*a*, which is fixedly secured to the central portion 40*a* of the support jig 40, is separateable from the plate body 61, which is fixedly secured to the opposite end portions 40*b*, 40*c* of the support jig 40. The central plate 60*a* of the second mounting plate 60 is carried by the central portion 30*a* of the jig bed 30 in such a manner that the central plate 60*a* superposes on the central plate 50*a* of the first mounting plate 50, with the engagement pins 52 engaged respectively in the engagement holes 63.

Therefore, when the jig bed 30 is retracted by operating the link mechanism 33, the opposite end portions 30*b*, 30*c* of the jig bed 30, carried by the central portion 30*a* of the jig bed 30, move in unison to their retracted positions 30*b*', 30*c*'. The support jig portions 40*a*, 40*b* and 40*c* are also moved in unison to their respective positions 40*a*', 40*b*, 40*c*', such that the molded product W is located at a position W' (FIG. 6). The opposite end portions 30*b*, 30*c* of the jig bed 30 can not retreat further. However, the central portion 30*a* of the jig bed 30, fixedly secured to the central plate 50*a* of the first mounting plate 50, may retreat further. Therefore, only the central plate 60*a* of the second mounting plate 60 (and the central portion 40*a* of the support jig 40), which is connected to the central plate 50*a* of the first mounting plate 50, is further retreated. Accordingly, the central portion 40*a* of the support jig 40*a* reaches a stop position 40*a*". As a result, a space H is formed beneath a central portion of the molded product W, and the molded product W is easily removed from the support jig 40. Also the next molded product W is easily placed on the support jig 40.

In the above embodiment, the support jig 40 (and the jig bed 30), is divided into the central portion 40*a* (and 30*a*) and the end portions 40*b*, 40*c* (and 30*b*, 30*c*). Each of the first and second mounting plates 50, 60 is also divided into a central portion and other portions. However, the support jig 40 and the jig bed 30 can be of a non-divided, integral construction, and the mounting plates 50, 60 can be of a non-divided, integral construction.

In the above embodiment, although the support jig 40 is linearly moved by the link mechanism 33, the support jig 40 may be fixed relative to the base 10.

As is clear from the above description, the present coating mask device accommodates products having different configurations by merely exchanging the mask support frame 20 and the support jig 40. The exchange operation of the mask support frame 20 and the support jig 40 is easy and quick, particularly when the coating mask device is incorporated in a production line. A required space for storing the removed mask support frames 20 and support jigs 40 is small.

By engaging the second mounting plate 60 with the convex and concave engagement portions of the first mounting plate 50, the support jig 40 is easily positioned relative to the jig bed 30. Therefore, the attachment of the support jig 40 is easy.

The support jig 40 is connected to and disconnected from the jig bed 30 by sliding the slide pin 70. Thus, the exchange operation of the support jig 40 is very easy.

The product W to be coated can be accurately positioned relative to the mask body W. Therefore, the coating is accurately applied to the product W.

What is claimed is:

1. A coating mask device comprising:

a base;

a jig bed mounted on said base;

a support jig, for receiving a product to be coated, mounted on said jig bed; and a mask support frame, having a mask body formed integrally therewith, mounted on said base so as to be pivotally moveable between (1) a closed position in which said mask body covers said support jig and (2) an open position in which said mask body exposes said support jig, said mask body corresponding in shape to said product to be coated;

wherein said mask support frame is detachably mounted on said base, and said support jig is detachably mounted on said jig bed.

2. A coating mask device according to claim 1, further comprising:

a first mounting plate mounted on said jig bed, said first mounting plate having first engagement portions; and a second mounting plate mounted on said support jig, said second mounting plate having second engagement portions;

wherein said first and said second mounting plates are fixed together in a superposed fashion through said first and said second engagement portions.

3. A coating mask device according to claim 2, further comprising:

a slide pin insertable into pin insertion holes provided through said first and said second engagement portions;

wherein said first and said second mounting plates are connected together and disconnected from each other by a sliding action of said slide pin into and out of said pin insertion holes.

4. A coating mask device according to claim 1, further comprising:

a mechanism which linearly moves said jig bed with respect to said base.

5. A coating mask device according to claim 4, wherein said mechanism is a link mechanism including (1) a first link having one end rotatably fastened to said base, and another free end, and (2) a second link having one end articulated to a central portion of said first link, and another end rotatably secured to said jig bed.

6. A coating mask device according to claim 5, further comprising:

an operating lever rotatably secured to said base, said operating lever having (1) a link engagement portion that engages with said free end of said first link, and (2) a handle engagement portion; and a handle rotatably secured to said mask support frame, said handle being adapted to engage with said handle engagement portion of said operating lever to impart rotational movement thereto;

wherein, when said handle is engaged with said handle engagement portion and rotated, said operating lever drives said first and said second links, thereby imparting linear movement to said jig bed.

7. A coating mask device according to claim 4, wherein each of said jig bed, a first and a second mounting plate, and said support jig has a central portion and a corresponding remainder portion, each said central portion being supported by said mechanism to be linearly displaceable over a greater distance than said corresponding remainder portion.

8. A coating mask device according to claim 2, wherein said first and said second engagement portions have convex and concave shapes.

9. A coating mask device according to claim 2, further comprising:

a mechanism which linearly moves said jig bed with respect to said base.

10. A coating mask device according to claim 3, further comprising:

a mechanism which linearly moves said jig bed with respect to said base.

11. A coating mask device comprising:

a base;

a jig bed mounted on said base;

a support jig, for receiving a product to be coated, mounted on said jig bed; and a mask support frame, having a mask body formed integrally therewith, mounted on said base so as to be pivotally moveable between (1) a closed position in which said mask body covers said support jig and (2) an open position in which said mask body exposes said support jig, said mask body corresponding in shape to said product to be coated;

wherein said mask support frame is detachably mounted on said base, and said support jig is detachably mounted on said jig bed, for coating a plurality of products having different configurations.

* * * * *